US006610147B2

(12) United States Patent
Aschenbeck

(10) Patent No.: US 6,610,147 B2
(45) Date of Patent: Aug. 26, 2003

(54) SHINGLE GRANULE VALVE AND METHOD OF DEPOSITING GRANULES ONTO A MOVING SUBSTRATE

(75) Inventor: David P. Aschenbeck, Newark, OH (US)

(73) Assignee: Owens-Corning Fiberglas Technology, Inc., Summit, IL (US)

( * ) Notice: Subject to any disclaimer, the term of this patent is extended or adjusted under 35 U.S.C. 154(b) by 0 days.

(21) Appl. No.: 09/944,968

(22) Filed: Aug. 31, 2001

(65) Prior Publication Data

US 2003/0044525 A1 Mar. 6, 2003

(51) Int. Cl.[7] ..... B05C 19/00
(52) U.S. Cl. ..... 118/308; 427/186; 427/424
(58) Field of Search ..... 118/308, 705, 118/19, 13; 427/186, 188, 424; 222/560, 64, 322, 333, 408, 409, 556, 557; 251/326

(56) References Cited

U.S. PATENT DOCUMENTS

| | | | | | |
|---|---|---|---|---|---|
| 1,295,609 | A | * | 2/1919 | Schulze | 222/502 |
| 1,419,169 | A | | 6/1922 | Overbury | |
| 2,728,685 | A | | 12/1955 | Muench | |
| 2,905,569 | A | | 9/1959 | Zitke | |
| 3,101,281 | A | | 8/1963 | Bowen | |
| 3,283,740 | A | | 11/1966 | Fredricksen | |
| 3,367,306 | A | | 2/1968 | Lawes et al. | |
| 3,403,817 | A | | 10/1968 | Morash | |
| 3,570,557 | A | | 3/1971 | Molins | |
| 3,730,397 | A | | 5/1973 | Magnus | |
| 4,478,869 | A | | 10/1984 | Brady et al. | |
| 4,795,301 | A | * | 1/1989 | Snead et al. | 414/339 |
| 4,800,102 | A | | 1/1989 | Takada | |
| 4,900,589 | A | | 2/1990 | Montgomery | |
| 5,024,356 | A | | 6/1991 | Gerling et al. | |
| 5,072,687 | A | | 12/1991 | Mitchell et al. | |
| 5,101,759 | A | | 4/1992 | Hefele | |
| 5,183,507 | A | * | 2/1993 | Scherer | 118/18 |
| 5,223,202 | A | * | 6/1993 | Hall | 264/219 |
| 5,380,552 | A | | 1/1995 | George et al. | |
| 5,382,291 | A | | 1/1995 | Olioso | |
| 5,417,165 | A | * | 5/1995 | Peppin et al. | 105/250 |
| 5,437,318 | A | * | 8/1995 | Kanzler et al. | 141/313 |
| 5,547,707 | A | | 8/1996 | Haubert | |
| 5,814,369 | A | | 9/1998 | Bockh et al. | |
| 5,858,095 | A | | 1/1999 | White et al. | |
| 5,997,644 | A | | 12/1999 | Zickell | |
| 6,095,082 | A | | 8/2000 | Belt et al. | |
| 6,228,422 | B1 | * | 5/2001 | White et al. | 118/308 |

* cited by examiner

*Primary Examiner*—Richard Crispino
*Assistant Examiner*—Michelle Aewedo Lazor
(74) *Attorney, Agent, or Firm*—Inger H. Eckert; James J. Dottavio

(57) ABSTRACT

Apparatus for depositing granules onto a substrate includes a hopper for containing granules, the hopper having a discharge slot, and a reciprocating gate mounted for rotation across the slot to open and close the slot. A method of depositing granules onto a moving substrate includes providing a hopper for containing granules, where the hopper has a discharge slot. A gate is moved across the slot to open and close the slot. When the slot is open granules fall from the hopper, and when the slot is closed granules are prevented from falling from the hopper. The method further includes detecting the speed of the substrate, and controlling the extent of opening of the slot by the gate to meter the granules falling from the hopper in response to the speed of the substrate.

36 Claims, 5 Drawing Sheets

SHINGLE GRANULE VALVE AND METHOD OF DEPOSITING GRANULES ONTO A MOVING SUBSTRATE

TECHNICAL FIELD

This invention relates to methods and apparatus for depositing granules onto a moving substrate. More particularly, this invention relates to methods and apparatus for controlling the flow of granules from a blend drop granule dispenser that supplies granules to be deposited onto the moving substrate.

BACKGROUND OF THE INVENTION

A common method for the manufacture of asphalt shingles is the production of a continuous strip of asphalt shingle material followed by a shingle cutting operation which cuts the material into individual shingles. In the production of asphalt strip material, either an organic felt or a glass fiber mat is passed through a coater containing liquid asphalt to form a tacky asphalt coated strip. Subsequently, the hot asphalt strip is passed beneath one or more granule applicators which apply the protective surface granules to portions of the asphalt strip material. Typically, the granules are dispensed from a hopper at a rate which can be controlled by making manual adjustments to the width of the discharge slot of the hopper. In the manufacture of colored shingles, two types of granules are employed. Headlap granules are granules of relatively low cost for portions of the shingle which are to be covered up. Colored granules or prime granules are of relatively higher cost and are applied to the portion of the shingle which will be exposed on the roof.

Not all of the granules applied to the hot, tacky, asphalt coated strip adhere to the strip, and, typically, the strip material is turned around a slate drum to invert the strip and cause the non-adhered granules to drop off. These non-adhered granules, which are known as backfall granules, are usually collected in a backfall hopper. The backfall granules are eventually recycled and discharged onto the sheet.

To provide a color pattern of pleasing appearance the colored shingles are provided in different colors, usually in the form of a background color and a series of granule deposits of different colors or different shades of the background color. These highlighted series of deposits, referred to as blend drops, are typically made by discharging granules from a series of blend drop granule dispensers. To produce the desired effect, the length and spacing of the blend drops must be accurate. The length and spacing of each blend drop on the sheet is dependent on the relative speed of the sheet and the length of time during which the blend drop granules are discharged.

A uniform distribution of blend drop granules on the sheet is also desired. A uniform distribution produces a sharp distinction between the blend drop and the background areas, and this provides a more pleasing appearance to the shingle. Also, a uniform distribution enables the blend drop to be applied with a minimum of excess granules, thereby reducing the amount of wasted prime granules that must be downgraded for use in the headlap area of the shingle. To produce a uniform distribution, a constant flow rate of granules during the discharge from the blend drop dispenser is desired.

One method of applying granules to the moving sheet involves discharging the granules from hoppers using a fluted roll at the hopper discharge slot. The fluted roll is rotated to discharge the blend drop granules onto the asphalt sheet. The roll is ordinarily driven by a drive motor, the roll being positioned in the drive or non-drive position by means of a brake-clutch mechanism. This mechanical action required to discharge the blend drop granules with a fluted roll is burdened with inherent limitations. The distribution of the granules from the fluted roll is very non-uniform, resulting in a general inability to provide sharp lines at the leading edge and trailing edge of the blend drops. Further, the duration of each granule discharge is too long to produce a short blend drop deposit on a sheet traveling at high machine speeds. Also, the discharge of blend drop granules cannot achieve a constant flow rate quickly enough to produce a uniform granule deposit. Consequently, there is a limit to the sharpness of the blend drops on the shingle using a fluted roll.

Another method of applying granules to the moving sheet involves discharging granules from a discharge slot in a linear nozzle, as disclosed in U.S. Pat. No. 5,746,830 to Burton et al. The granules are fed to the nozzle from a hopper. The discharge of granules from the linear nozzle is controlled by regulating the atmospheric pressure above the accumulation of granules in the nozzle. Increased or positive pressure above the granules in the nozzle causes the granules to flow through the discharge slot, and a negative pressure causes the granules to clog the discharge slot, thereby stopping the flow of granules through the slot.

U.S. Pa. No. 6,228,422 to White et al. discloses a granule discharging apparatus in which the flow of granules from a hopper discharge slot is regulated by a slide gate that is arranged to be reciprocated linearly to open and close the discharge slot. The slide gate is operated to change to discharge slot to full open condition every time there is a blend drop. Therefore, there is no mechanism to vary the flow to accommodate changes in the linespeed of the moving sheet.

It is desired to provide an improved method and apparatus for discharging blend drop granules onto the moving sheet to produce a deposit having a uniform distribution of granules. It is particularly desirable to provide a granule depositing system that is more responsive to changes in line speed of the asphalt coated sheet, particularly at the higher line speeds. Also, it would be helpful to have a granule depositing system with more accurate controls of the blend drops to provide increased granule efficiency and improved blend drop appearance. It would also be beneficial to have a blend drop granule dispenser that more accurately opens and closes the granule deposition mechanism in response to changes in line speed.

SUMMARY OF THE INVENTION

The above objects as well as other objects not specifically enumerated are achieved by apparatus for depositing granules onto a substrate, where the apparatus includes a hopper for containing granules, the hopper having a discharge slot, and a reciprocating gate mounted for rotation across the slot to open and close the slot.

According to this invention there is also provided apparatus for depositing granules onto a substrate, where the granules have a median diameter. The apparatus includes a hopper for containing granules, the hopper having a discharge slot. A gate is mounted for movement across the slot to open and close the slot. The gate has a leading edge with a thickness that is within the range of from about 0.2 to about 1.5 times the median diameter of the granules.

According to this invention there is also provided apparatus for depositing granules onto a substrate, the granules having a median diameter. The apparatus includes a hopper for containing granules, the hopper having a discharge slot having a width. An elongated gate is mounted for movement across the slot to open and close the slot. The gate has a leading edge and a shank portion extending back from the leading edge for a distance of at least the width of the slot, wherein the thickness of the shank portion is less than about 400 mils.

According to this invention there is also provided a method of depositing granules onto a moving substrate. The method includes providing a hopper for containing granules, where the hopper has a discharge slot. A gate is moved across the slot to open and close the slot. When the slot is open granules fall from the hopper, and when the slot is closed granules are prevented from falling from the hopper. The method further includes detecting the speed of the substrate, and controlling the extent of opening of the slot by the gate to meter the granules falling from the hopper in response to the speed of the substrate.

According to this invention there is also provided a method of depositing granules onto a moving substrate. The method includes providing a hopper for containing granules, where the hopper has a discharge slot, and moving a gate across the slot to open and close the slot. When the slot is open granules fall from the hopper, and when the slot is closed granules are prevented from falling from the hopper. The method includes controlling the speed of the movement of the gate, and independently controlling the extent of opening of the slot by the gate to meter the granules falling from the hopper.

According to this invention there is also provided a method of depositing granules onto a moving substrate. The method includes providing a hopper for containing granules, the hopper having a discharge slot, and moving a gate across the slot to open and close the slot. When the slot is open granules fall from the hopper, and when the slot is closed granules are prevented from falling from the hopper. The method further includes controlling the acceleration rate of the gate during the opening of the slot so that the acceleration rate does not exceed about 3 g.

According to this invention there is also provided a method of depositing granules onto a moving substrate. The method includes providing a hopper for containing granules, the hopper having a discharge slot, and moving a gate across the slot to open and close the slot. When the slot is open granules fall from the hopper, and when the slot is closed granules are prevented from falling from the hopper. The method further includes controlling the acceleration of the gate during the opening of the slot so that the acceleration rate is positive during a first portion of the opening of the slot, and the acceleration rate is approximately zero during a second portion of the opening of the slot.

According to this invention there is also provided a method of depositing granules onto a moving substrate. The method includes providing a hopper for containing granules, the hopper having a discharge slot, and moving a gate across the slot to open and close the slot. When the slot is open granules fall from the hopper, and when the slot is closed granules are prevented from falling from the hopper. The method further includes controlling the velocity of the gate during the closing of the slot so that the velocity does not exceed about 130 ft./min.

Various objects and advantages of this invention will become apparent to those skilled in the art from the following detailed description of the preferred embodiments, when read in light of the accompanying drawings.

DETAILED DESCRIPTION OF THE INVENTION

Figure 1:
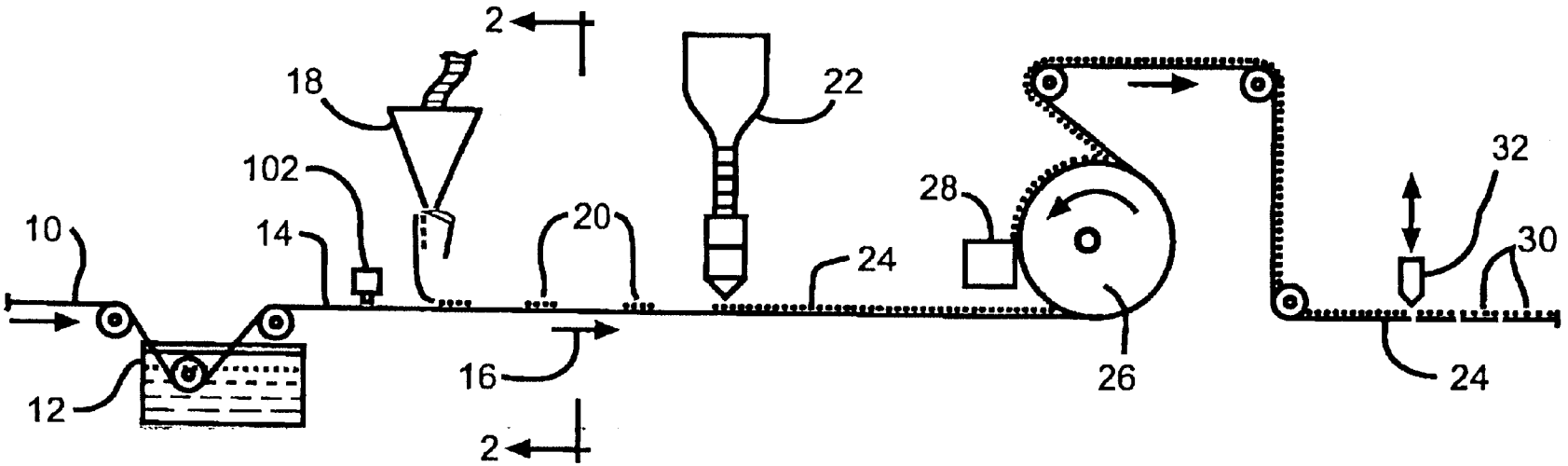
FIG. 1 is a schematic elevational view of a shingle manufacturing operation according to the invention.

As shown in FIG. 1, the shingle base mat 10, preferably a fiberglass mat, is passed through an asphalt coater 12 to form an asphalt coated sheet 14. The asphalt coated sheet 14 moves in the machine direction, indicated by arrow 16. Blend drop granule dispensers 18, only one of which is shown, are positioned above the asphalt coated sheet. These blend drop dispensers 18 are designed to apply blend drops 20 onto the asphalt coated sheet 14. Different ones of the plurality of blend drop dispensers 18 can be arranged to apply blend drops 20 of different shapes and color blends. The use of multiple blend drop dispensers is well known in the art.

Subsequent to the application of the blend drops 20 by all the blend drop dispensers 18, the background granule dispenser 22 applies background granules to the asphalt coated sheet 14. The background granules adhere to the portions of the asphalt coated sheet that not are already covered by the blend drop granules, and the complete coating of granules forms a granule covered sheet 24. The granule covered sheet 24 is then turned around a slate drum 26 where excess granules drop off and are collected in a backfall hopper 28 for subsequent reuse in the shingle making operation. After passing around the slate drum, the granule covered sheet 24 is cooled, cut into individual shingles 30 by a chopper 32, and packaged in bundles, not shown, for transportation to customers.

Figure 2:
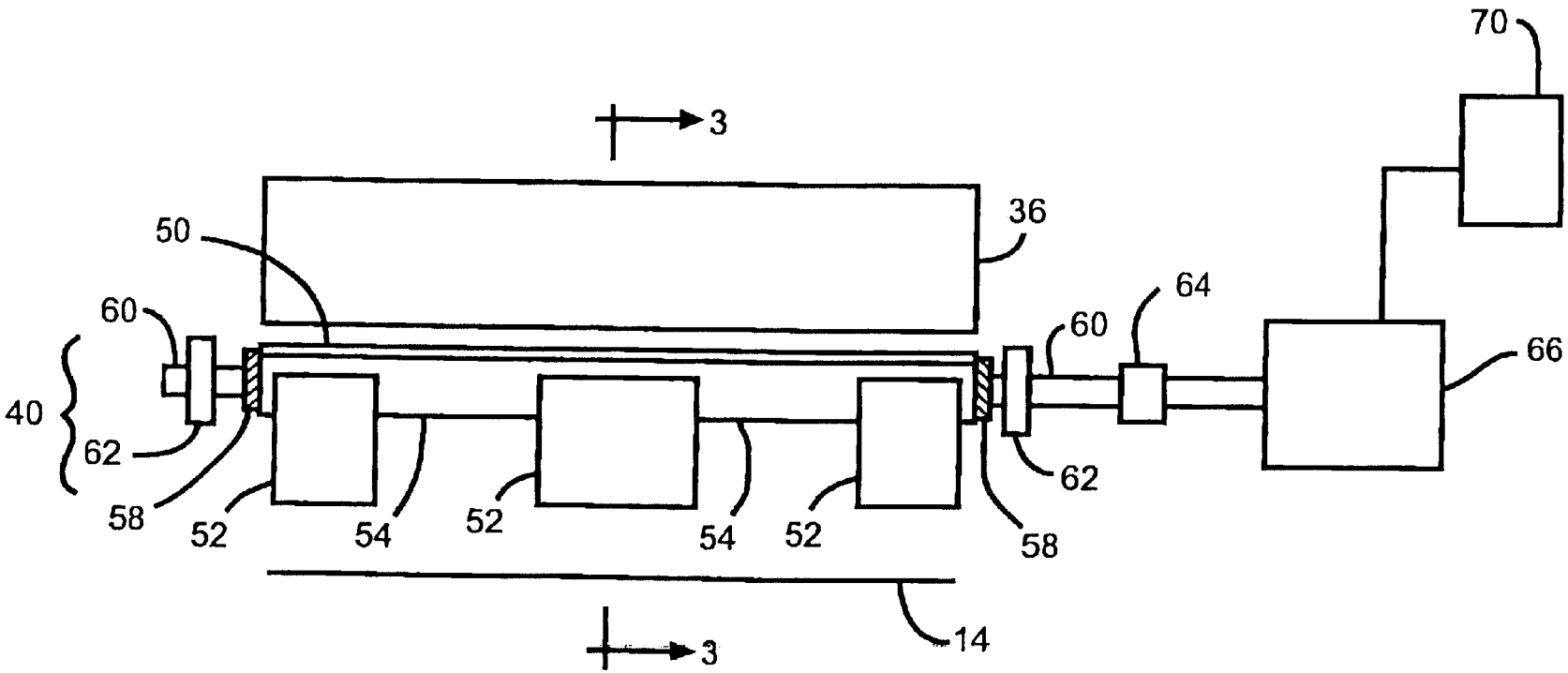
FIG. 2 is a schematic view in elevation of the granule applicator of the invention, taken along line 2—2 of FIG. 1.
Figure 3:
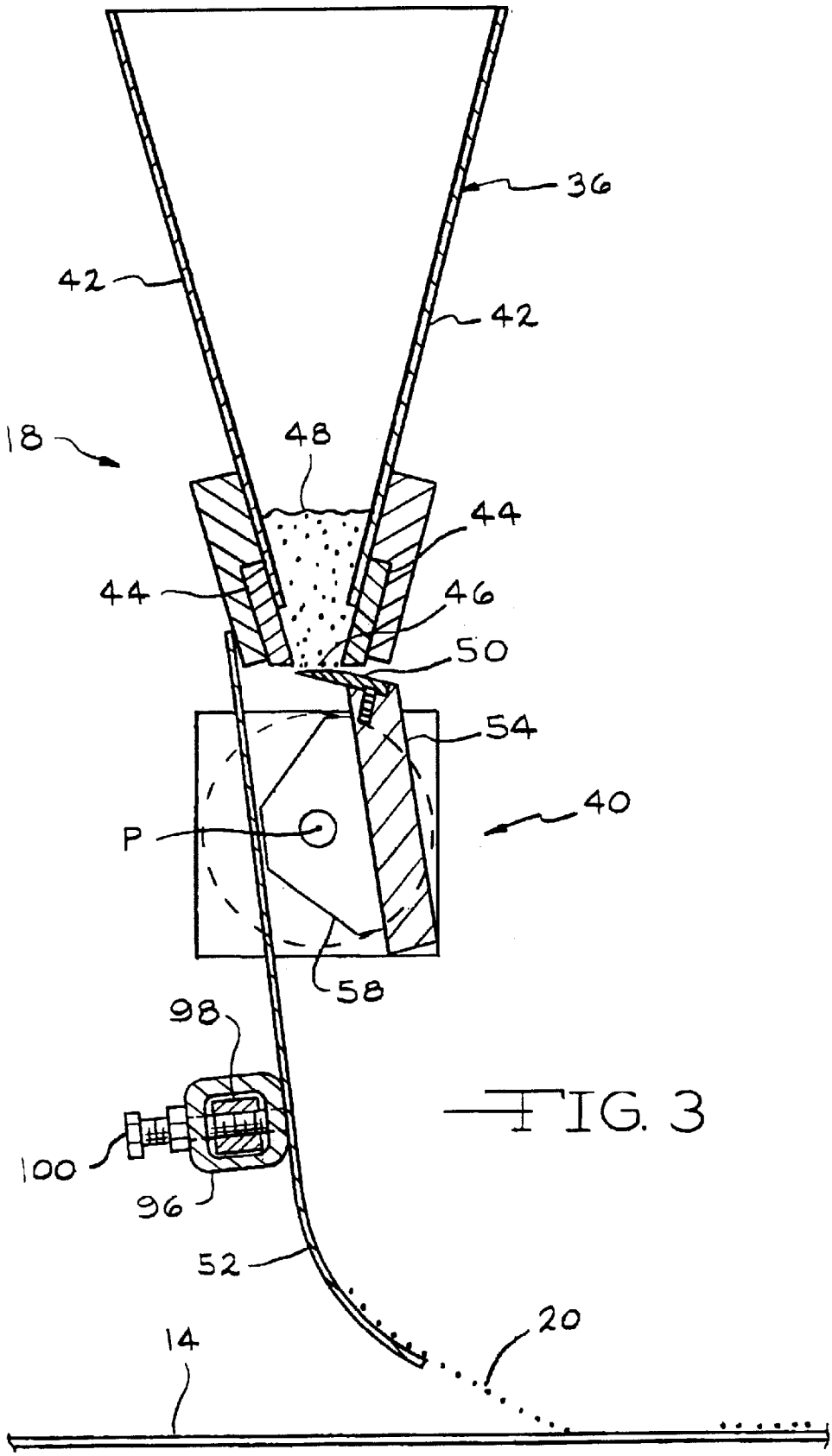
FIG. 3 is a cross-sectional view in elevation of the granule applicator of the invention, taken along line 3—3 of FIG. 2.

As shown in FIGS. 2 and 3, the blend drop dispensers 18 are generally comprised of a hopper 36 and a mechanism, generally indicated at 40 for metering and delivering granules from the hopper 36 onto the asphalt coated sheet 14 to form the blend drops 20. The hopper 36 is generally comprised of converging walls 42, and optionally can be provided with wear plates 44 that can be replaced when desired. Granules 48 are fed to the hopper from granule supplies, not shown. The discharge slot 46 is the gap or space between the lowermost edges of the wear plates 44. In the event that the wear plates are not used, the discharge slot will be defined by the lowermost edges of the hopper walls 42. Optionally, the walls 42 and/or the wear plates 44 can be provided with an adjustability feature to enable changes in the size or shape of the discharge slot 46. The hopper 36 extends transversely across the moving asphalt coated sheet 14, and the discharge slot 46 is generally linear across the width of the shingle machine or portions of the shingle machine. It is to be understood that some shingle machines will be set up to make multiple shingles simultaneously, and blend drops are not needed in the headlap areas of the shingles. Therefore, although the discharge slot is typically continuous extending transverse to the machine direction, i.e., across the asphalt coated sheet, the hopper 36 is provided with dividers, not shown, that act to allow delivery of the granules the desired transverse sections of the slot 46.

The mechanism 40 for metering and delivering granules to form the blend drops 20 includes a movable gate 50 for opening and closing the discharge slot 46 of the hopper 36, and a chute 52 for directing the blend drops 20 onto the asphalt coated sheet 14. The gate 50 acts as a valve for dispensing the granules from the hopper 36. Preferably, the gate 50 is made of a hard material, such as steel. The gate 50 is mounted for reciprocal movement on a gate support member 54 in close proximity to the discharge slot 46 of the hopper so that reciprocation of the gate opens and closes the discharge slot to meter the granules 48 from the hopper 36. The spacing between the gate and the bottom of the adjustable plates 44 is approximately ⅛ inches. The gate support member 54 is preferably a generally flat bar, and is mounted for rotation about a pivot point P. The gate support member can be any structural member suitable for mounting the gate 50 for reciprocal movement. Ideally, the gate support member is oriented generally vertically so that it will not interfere with the blend drop granules falling from the hopper. Preferably, the gate support member 54 is made of a strong but light weight material, such as aluminum.

The rotation of the gate support member 54 causes the gate 50 to travel through an arc, about pivot point P. Since the discharge slot 46 is typically less than an inch in width, the arc necessary for travel of the gate to open and close the discharge slot 46 is less than about 30 degrees, and preferably less than about 20 degrees. In a typical construction, the width W of the discharge slot is about 0.65 inches, and the reciprocal movement of the gate is about 0.75 inches. While the reciprocal movement of the gate has been shown to be movement along an arc, it is to be understood that the reciprocal movement can be in a plane, i.e., linear. Further, while the arcuate movement of the gate 50 shown in the drawings is a reciprocal movement, it is to be understood that a plurality of gates, not shown, could be used to pass across the slot 46 seriatim to open and close the slot to create blend drops. In such an arrangement, the plurality of gates could be in the form of a wheel, not shown, having the gates at its circumference, or the gates could be in the form of a conveyor belt, not shown, containing the plurality of gates and positioned to pass directly beneath the discharge slot.

Figure 4:
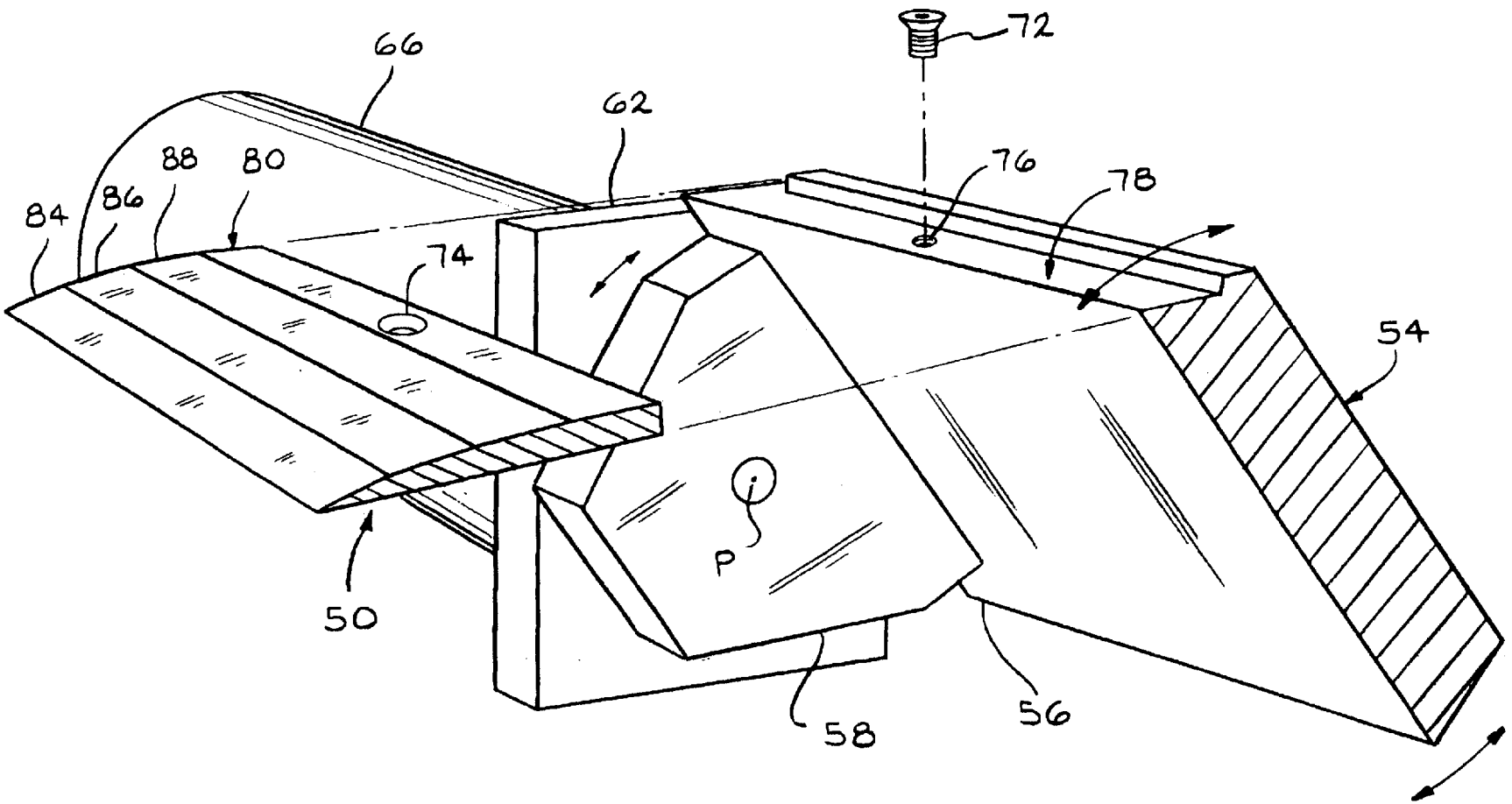
FIG. 4 is a perspective view of the framework for mounting the gate supports of the granule applicator.

As shown in FIGS. 3 and 4, the gate support member 54 is attached at its ends 56 to a pair of rotatably mounted mounting blocks 58, only one of which is shown in FIG. 4. The mounting blocks 58 are mounted on shafts 60 coincident with pivot point P, and the shafts 60 are mounted in bearings 62 for rotation about pivot point P. One of the shafts is connected through a coupler 64 to a motor 66, which preferably is a servo motor. A controller 70 is connected to the servo motor to control its operation. Although the gate is illustrated as being reciprocated through an arcuate path with a servo motor 66, it is to be understood that any suitable means for reciprocating the gate to open and close the discharge slot 46 can be used. For example, the gate could be reciprocated with a linear servo motor, a linear actuator or a cam/linkage mechanism. An important advantage of the servo motor and connections shown in the drawings is that rotary indirect movement or play associated with prior art rotational devices is nearly eliminated. The connection to the motor 66 is practically direct, and unintended rotational freedom of movement is limited to a single precision rotary coupling 62 and the rotary flex in the shafts 60. Further, the light weight nature of the gate support member 54 and the gate 50 minimizes inertia, thereby enabling faster and more precise movement of the gate.

Figure 5:
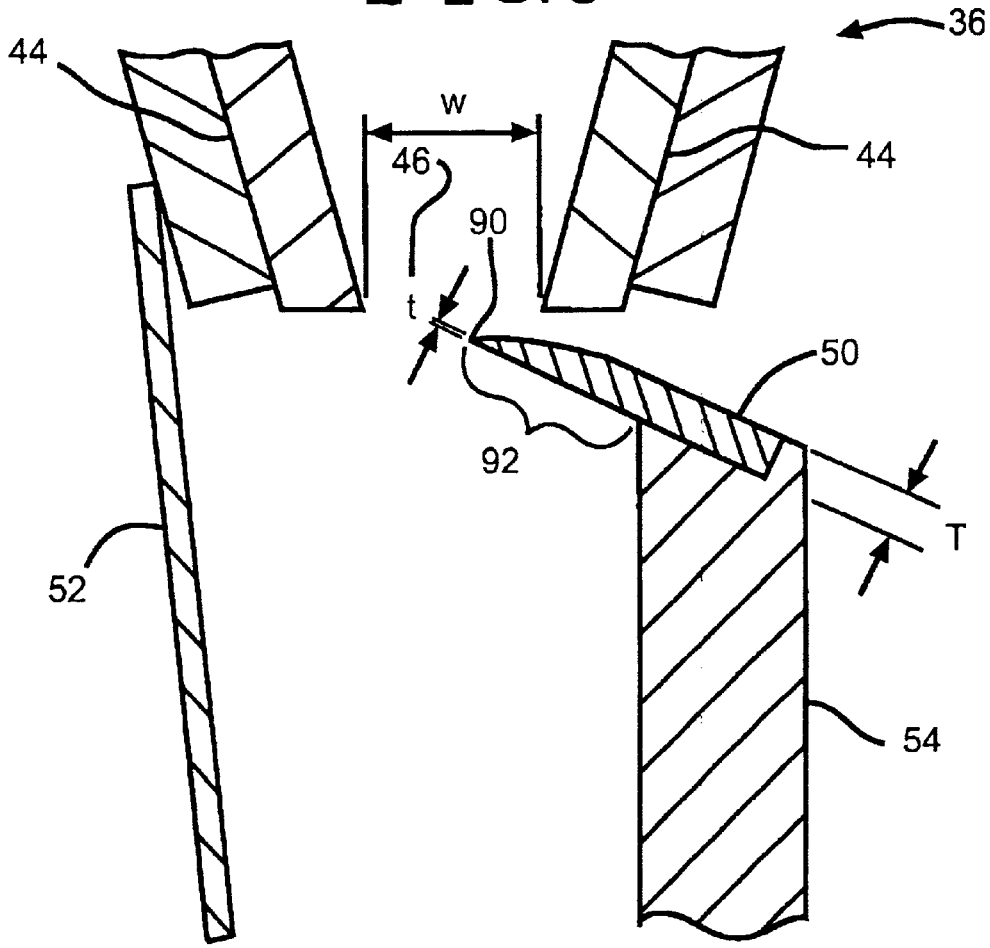
FIG. 5 is a view in elevation of the gate and hopper of the invention, with the slot partially open.

FIGS. 3–5 illustrate that the gate 50 is mounted on the gate support member 54 by means of threaded fasteners, such as screw 72. Other types of mounting for the gate can be used. The gate 50 has a screw aperture 74, and there is a threaded aperture 76 in the edge 78 of the gate support member 54 to allow the screw to hold the gate 50 firmly in place on the support member 54. A preferred shape for the top surface 80 of the gate 50 is a curved surface. For ease of manufacturing, a curved surface can be approximated by using a number of planar surfaces extending transverse to the machine direction, such as planar surfaces 84, 86 and 88. Any number of planar surfaces can be used to approximate a curved surface. The three planar surfaces 84, 86 and 88 are at acute angles to each other, forming a substantially curved upper surface.

As shown in FIG. 5, the cross-sectional shape of the gate 50 is elongated, with a leading edge 90 and a shank portion 92. It is preferred that the leading edge 90 be relatively thin to minimize the scattering of the blend drop granules as the gate rotates or reciprocates to close the discharge slot 46. The scattered granules are intercepted by the chute 52. Preferably, the thickness t of the leading edge 90 is within the range of from about 0.2 to about 1.5 times the median diameter of the granules. Typical prime granules have a size distribution allowing approximately 95 percent of the granules to pass through a U.S. No. 12 sieve, which has orifices having a diameter on the order of 65 mils. Further, typical prime granules have a size distribution allowing approximately 42 percent of the granules to pass through a U.S. No. 16 sieve, which has orifices having a diameter on the order of about 46 mils. From this, an assumption can be made that the prime granules have a median diameter of about 50 mils. Therefore, as best shown in FIGS. 3 and 5, the thickness t of the leading edge 90 is within the range of from about 10 mils to about 75 mils. More preferably, the thickness of leading edge 90 is less than about 50 mils, and most preferably less than about 20 mils.

The shank portion 92 of the gate extends back from the leading edge 90 of the gate for a distance that is as great as, or nearly as great as the width W of the discharge slot 46. Further, the thickness T of the shank portion 92 is preferably less than about 400 mils. The purpose of such a thin and elongated gate structure is that the gate must not bump into or interfere with the uppermost granules in a vertically oriented, falling blend drop when the gate is in the process of moving across the discharge slot to close off the flow of granules. Even more preferably, the thickness T of the shank portion 92 is less than about 200 mils.

In operation, the hopper 36 of the blend drop dispenser 18 is supplied with a supply of granules 48. The discharge slot 46 is kept closed by the gate 50, thereby preventing the granules from being discharged. The asphalt coated sheet 14 is being driven beneath the blend drop dispensers 18. When a blend drop is to be deposited onto the asphalt coated sheet, the controller 70 causes the servo motor to rotate, thereby rotating the gate 50 to open the discharge slot. With the discharge slot open, the granules fall downwardly. When the flow of granules is to be stopped, the controller signals the servo motor 66 to rotate the gate 50 back across the discharge slot 46 to close it.

As the gate closes the discharge slot 46, the leading edge 90 of the gate 50 will strike some of the granules, knocking them sideways into the chute 52. These granules will slide down the chute and remain a part of the blend drop. The chute may be provided with side walls, not shown, to maintain the granules in the proper lane. Further, as shown in FIG. 3 the chute 52 may be mounted using a steel channel 96 that extends transversely across the shingle machine, and is mounted on a stationary inner channel 98. The channel 96 may be provided with clamps 100 to fix the position of the chute after the chute is given the desired transverse position.

The use of the controller 70 and a means, such as the servo motor 66, for reciprocating the gate 50, allows several beneficial operating features according to the invention. The use of a servo motor enables the controller to detect the exact position of the gate at all times, and therefore the controller can precisely control the exact position of the gate with respect to the discharge slot. The controller can be programmed to operate the gate for opening the discharge slot to an extent less than completely open. For example, the controller can provide for opening the slot to a half open position. This would allow granules to be discharged at approximately half the maximum possible rate. This method enables the granules from the hopper to be metered out in a controlled fashion, as dictated by the controller 70. This ability to move the gate to the extent necessary to achieve a selected percentage of the slot being opened allows great flexibility in operating the shingle machine. A practical application of this feature is that when the speed of the substrate or asphalt coated sheet 14 is known, such as by the use of a line speed detector 102, as shown in FIG. 1, the extent of opening of the slot by the gate can be controlled to meter the granules falling from the hopper in response to the speed of the substrate. Line speed detectors are well known in the art. Accordingly, as the line speed increases, the controller will operate the gate so that it will open the slot to a more open position. It is desirable to have a relatively constant flow rate of granules, within the range of from about 1.0 to about 1.6 grams of granules per square inch of substrate, regardless of the speed of the substrate. Typically, only about 1.0 gram of granules remains on the asphalt coated sheet after complete processing.

Another feature of the invention pertains to the ability of the controller to control the velocity and/or acceleration rate of the gate 50 during the opening and closing of the discharge slot 46. In general, as the line speed of the asphalt coated sheet 14 increases, the acceleration rate of the gate 50 during opening and closing of the discharge slot must be increased to maintain a sharp-edged blend drop on the asphalt coated sheet. However, there are instances where it is desirable to control the velocity and/or acceleration rate of the gate 50. For example, where a blend drop having a feathering or smear of blend drop granules is required at a low line speed, the gate may be controlled to accelerate at a low rate, thereby mimicking the visual effect of the smear of granules at a high line speed.

There are reasons for limiting the acceleration rate of the gate. Acceleration of the gate during opening of the slot at too high a rate can cause an undesirable initial slug or excess amount of granules. Also, when the gate is closed, excessive acceleration rates for the gate will knock more of the granules into the contact with the chute 52, thereby disturbing the visual uniformity of the granules at the rear or tail of the blend drop. Finally, some blend drop patterns may require different velocities and acceleration rates for the gate. It is preferred that the acceleration and deceleration rates be kept at a level lower than about 3 g, and more preferably at approximately 2 g. Also, preferably the velocity of the gate during the closing of the slot is controlled so that it does not exceed about 130 ft./min. This minimizes the amount of granules that are scattered by the leading edge of the gate.

Figure 6:
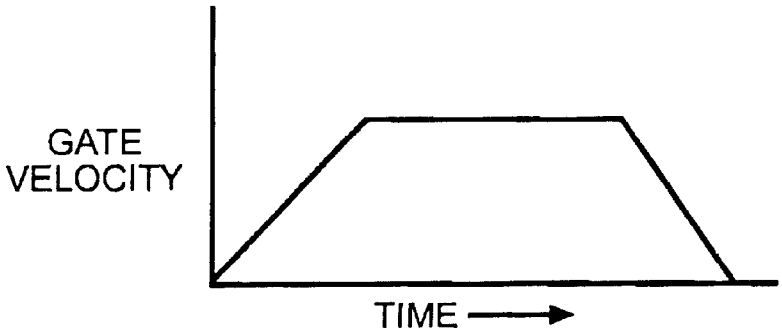
FIG. 6 is a graph of the velocity of the gate during the opening of the gate according to one embodiment of the invention.

A further aspect of the present invention is that the controller can be programmed to control the acceleration and velocity of the gate independently of the controlling of the extent of the opening of the slot by the gate. This independent control of the two functions, acceleration of the gate and degree of opening of the slot, provides great flexibility to the operators of the shingle machine. An example of how this could work is illustrated in FIG. 6. At time zero, the gate begins to accelerate at a constant rate. The gate velocity increases from zero to a desired level. Then the acceleration becomes zero and the gate is moving at a constant velocity, as evidenced by the flat part of the curve in FIG. 6. Finally, the gate decelerates so that it comes to rest, with a velocity of zero. Preferably, the acceleration drops to zero, i.e., the velocity levels off, when the velocity reaches a value that is within the range of from about 10 to about 190 ft./min. During manufacturing of shingles having a need for relatively precise blend drops, such as laminated shingles with a slate or threedimensional look, the leveling off velocity is at the high end of the range, such as greater than about 90 ft./min. For manufacturing shingles where a more muted blend drop is needed, such as classic three-tab shingles, the leveling off velocity is at the low end of the range, such as less than about 30 ft./min.

The principle and mode of operation of this invention have been described in its preferred embodiments. However, it should be noted that this invention can be practiced otherwise than as specifically illustrated and described without departing from its scope.

What is claimed is:

1. Apparatus for depositing granules onto a substrate comprising:

a hopper for containing granules, the hopper having a discharge slot; and a reciprocating gate mounted for rotation across the slot to open and close the slot;

wherein the gate has a substantially curved upper surface comprised of different planar surfaces at acute angles to each other.

2. The apparatus of claim 1 including means for rotating the gate about a pivot point.

3. The apparatus of claim 1 in which the gate is mounted on a gate support, with the gate support being mounted on a pair of rotatably mounted mounting blocks.

4. The apparatus of claim 1 including a chute positioned to direct blend drops onto the substrate.

5. The apparatus of claim 1 in which the gate is mounted for rotation through an arc that is less than about 30 degrees.

6. The apparatus of claim 1 in which the gate is mounted for rotation through an arc that is less than about 20 degrees.

7. The apparatus of claim 1 in which the gate is mounted for rotation through a distance of about 0.75 inches.

8. The apparatus of claim 1 in which the reciprocating gate is mounted on a gate support member that extends transverse with respect to the substrate, the gate support member being oriented generally vertically.

9. The apparatus of claim 1 in which the reciprocating gate is mounted on an elongated gate support member that extends transverse with respect to the substrate, the gate support member being supported and rotatably mounted at its ends.

10. The apparatus of claim 1 wherein the gate is mounted on a gate support member that is connected to a motor for rotation, and wherein the motor is connected to a controller that is adapted to operate the motor to move the gate to the extent necessary to achieve a selected percentage of the slot being opened.

11. The apparatus of claim 1 including a detector for determining the speed of the substrate, wherein the gate is mounted on a gate support member that is connected to a motor for rotation, and wherein the motor is connected to a controller that is adapted to operate the motor to move the gate to the extent necessary to meter the granules falling from the hopper in response to the speed of the substrate.

12. The apparatus of claim 1 including a detector for determining the speed of the substrate, wherein the gate is mounted on a gate support member that is connected to a motor for rotation, and wherein the motor is connected to a controller that is adapted to operate the motor to (a) control the speed of the movement of the gate, and (b) independently control the extent of opening of the slot by the gate to meter the granules falling from the hopper.

13. The apparatus of claim 1 in which the gate has a leading edge with a thickness that is within the range of from about 0.2 to about 1.5 times the median diameter of the granules.

14. The apparatus of claim 13 in which the thickness of leading edge is less than about 50 mils.

15. The apparatus of claim 1 in which the gate has a leading edge and a shank portion extending back from the leading edge for a distance of at least the width of the slot, wherein the thickness of the shank portion is less than about 400 mils.

16. The apparatus of claim 15 in which the thickness of the shank portion is less than about 200 mils.

17. Apparatus for depositing granules onto a substrate, the granules having a median diameter, the apparatus comprising:

a hopper for containing granules, the hopper having a discharge slot;

a gate mounted for movement across the slot to open and close the slot, the gate having a leading edge with a thickness that is within the range of from about 10 mils to about 75 mils.

18. The apparatus of claim 17 in which the thickness of leading edge is less than about 50 mils.

19. The apparatus of claim 17 in which the gate has a leading edge and a shank portion extending back from the leading edge for a distance of at least the width of the slot, wherein the thickness of the shank portion is less than about 400 mils.

20. Apparatus for depositing granules onto a substrate comprising:

a hopper for containing granules, the hopper having a discharge slot; and a reciprocating gate mounted for rotation across the slot to open and close the slot, the gate having a leading edge with a thickness that is within the range of from about 10 mils to about 75 mils.

21. The apparatus of claim 20 including means for rotating the gate about a pivot point.

22. The apparatus of claim 20 in which the gate is mounted on a gate support, with the gate support being mounted on a pair of rotatably mounted mounting blocks.

23. The apparatus of claim 20 including a chute positioned to direct the blend drops onto the substrate.

24. The apparatus of claim 20 in which the gate is mounted for rotation through an arc that is less than about 30 degrees.

25. The apparatus of claim 20 in which the gate is mounted for rotation through an arc that is less than about 20 degrees.

26. The apparatus of claim 20 in which the gate is mounted for rotation through a distance of about 0.75 inches.

27. The apparatus of claim 20 in which the gate has a substantially curved upper surface.

28. The apparatus of claim 27 in which the gate has an upper surface comprised of different planar surfaces at acute angles to each other.

29. The apparatus of claim 20 in which the reciprocating gate is mounted on a gate support member that extends transverse with respect to the substrate, the gate support member being oriented generally vertically.

30. The apparatus of claim 20 in which the reciprocating gate is mounted on an elongated gate support member that extends transverse with respect to the substrate, the gate support member being supported and rotatably mounted at its ends.

31. The apparatus of claim 20 wherein the gate is mounted on a gate support member that is connected to a motor for rotation, and wherein the motor is connected to a controller that is adapted to operate the motor to move the gate to the extent necessary to achieve a selected percentage of the slot being opened.

32. The apparatus of claim 20 including a detector for determining the speed of the substrate, wherein the gate is mounted on a gate support member that is connected to a motor for rotation, and wherein the motor is connected to a controller that is adapted to operate the motor to move the gate to the extent necessary to meter the granules falling from the hopper in response to the speed of the substrate.

33. The apparatus of claim 20 including a detector for determining the speed of the substrate, wherein the gate is mounted on a gate support member that is connected to a motor for rotation, and wherein the motor is connected to a controller that is adapted to operate the motor to (a) control the speed of the movement of the gate, and (b) independently control the extent of opening of the slot by the gate to meter the granules falling from the hopper.

34. The apparatus of claim 20 in which the thickness of leading edge is less than about 50 mils.

35. The apparatus of claim 20 in which the gate has a leading edge and a shank portion extending back from the leading edge for a distance of at least the width of the slot, wherein the thickness of the shank portion is less than about 400 mils.

36. The apparatus of claim 35 in which the thickness of the shank portion is less than about 200 mils.

* * * * *